US005351355A

United States Patent [19]

Chiniara

[11] Patent Number: 5,351,355

[45] Date of Patent: Oct. 4, 1994

[54] SWIMMING POOL CLEANER

[76] Inventor: Paul Chiniara, 9044 Rimouski, Brossard, Quebec, Canada, J4X 2S2

[21] Appl. No.: 67,281

[22] Filed: May 26, 1993

[51] Int. Cl.[5] ..... E04H 3/20

[52] U.S. Cl. ..... 15/1.7

[58] Field of Search ..... 15/1.7

[56] References Cited

U.S. PATENT DOCUMENTS 2,988,762 6/1961 Babcock ..... 15/1.7
3,416,176 12/1968 Ravitts ..... 15/1.7

FOREIGN PATENT DOCUMENTS 446008 7/1912 France ..... 15/1.7

*Primary Examiner*—Edward L. Roberts
*Attorney, Agent, or Firm*—George A. Seaby

[57] ABSTRACT

The majority of currently available, submersible swimming pool cleaners operate in a random manner, i.e. follow no set path of travel along the bottom of a swimming pool. The result is that a lengthy period of time and large power consumption are required to clean an entire swimming pool. This problem is solved by a swimming pool cleaner of the submersible type including a casing which tapers from one end to the other thereof, a pair of wheels at the wide end of the casing, a single wheel at the narrow end of the casing, a drive system for driving each of the wheels, a cable for connecting the cleaner to a fixed point on one side of the pool, a cable tensioning device in the casing for changing the length and tension on the cable whereby the cleaner is caused to follow a predetermined path of travel over the entire inside area of the swimming pool.

6 Claims, 7 Drawing Sheets

SWIMMING POOL CLEANER

BACKGROUND OF THE INVENTION

1. Field of the Invention

This invention relates to a swimming pool cleaner, and in particular to a pool cleaner of the submersible type.

2. Discussion of the Prior Art

Submersible swimming pool cleaners are by no means new. Generally, such cleaners operate in a random manner, i.e. follow no set path of travel along the bottom of a swimming pool. A pool cleaner of this type is disclosed, for example by U.S. Pat. No. 4,558,479, which issued to P. Breskovics et al on Dec. 17, 1985. A problem with random movement cleaners is the lengthy period of time required to clean an entire swimming pool, and consequently the large power consumption involved in such an operation.

A solution to the problem of random movement cleaners is provided by cleaners following a predetermined path of travel. An example of a pool cleaner of this type is disclosed by U.S. Pat. No. 2,988,762, issued to H. H. Babcock on Jun. 20, 1961. The Babcock device relies on mechanical sensors for determining when turning and the reversing of the direction of travel should be effected. In other words, there is no positive control of the path of travel of the cleaner, and accordingly there is a distinct possibility that the path of travel will be erratic, and that areas of the pool bottom will be missed.

It is readily apparent that a need exists for a swimming pool cleaner, which is capable of quickly cleaning an entire pool bottom in an efficient manner. The object of the present invention is to meet such need by providing a relatively simple swimming pool cleaner, which follows a predetermined path of travel, and which will ensure the cleaning of the entire area traversed by the cleaner.

GENERAL DESCRIPTION OF THE INVENTION

Accordingly, the present invention relates to a swimming pool cleaner of the submersible type comprising casing means; first wheel means on one end of said casing means; second wheel means on the other end of said casing means; brush means rotatably mounted on said casing means for dislodging dirt from a pool bottom; pump means in said casing means for pumping water through said casing means; filter means in the path of travel of the water pumped by said pump means for removing dirt from the water; reversible drive means for rotating said first and second wheel means and said brush means; switch means for causing the drive means to reverse the direction of travel upon reaching a pool wall; cable means for connecting said casing means to a point on the periphery of the swimming pool for causing the cleaner to follow an arcuate path of travel dependent upon the distance between the cleaner and said point; winding means for changing the length of said cable means whereby the distance between said point and the cleaner is changed; release means for releasing tension on said cable means; and spring means biasing said second wheel means to a turning position, whereby, by changing the tension on said cable means, while continuing to drive said wheel means, the cleaner can be caused to turn to effect corrections to the path of travel of the cleaner.

The invention will be described in greater detail with reference to the accompanying drawings, which illustrate a preferred embodiment of the invention, and wherein.

Figure 1:
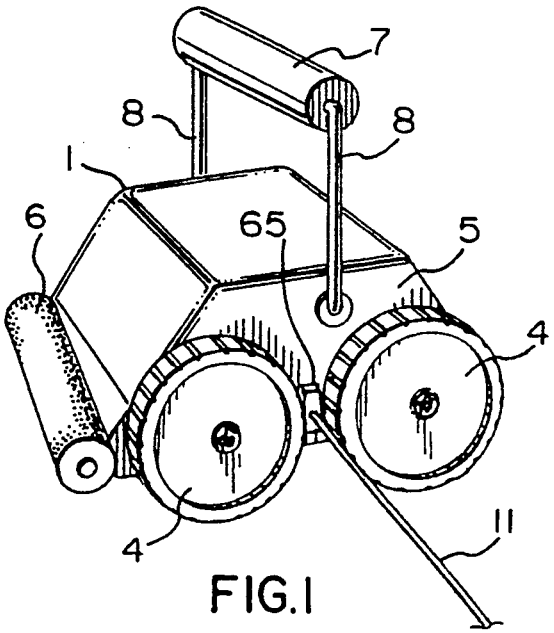
FIG. 1 is a schematic, perspective view of a swimming pool cleaner in accordance with the present invention from one end thereof.
Figure 2:
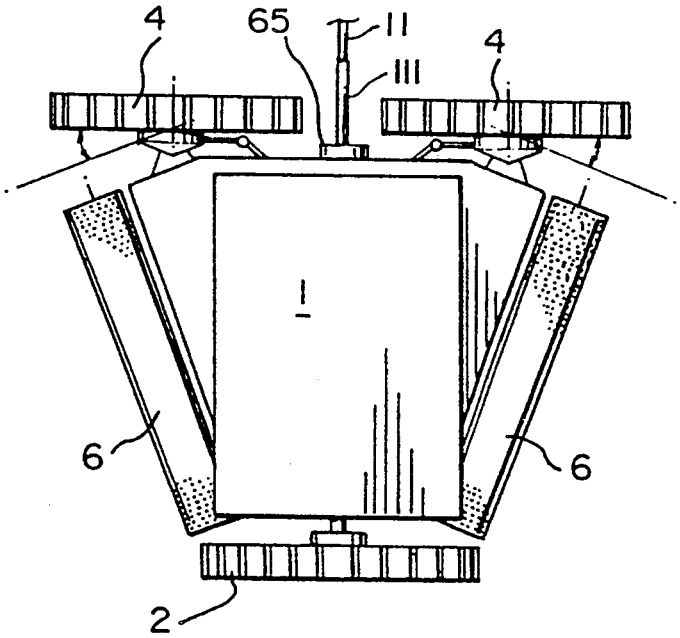
FIG. 2 is a schematic, plan view of the swimming pool cleaner of FIG. 1.
Figure 3:
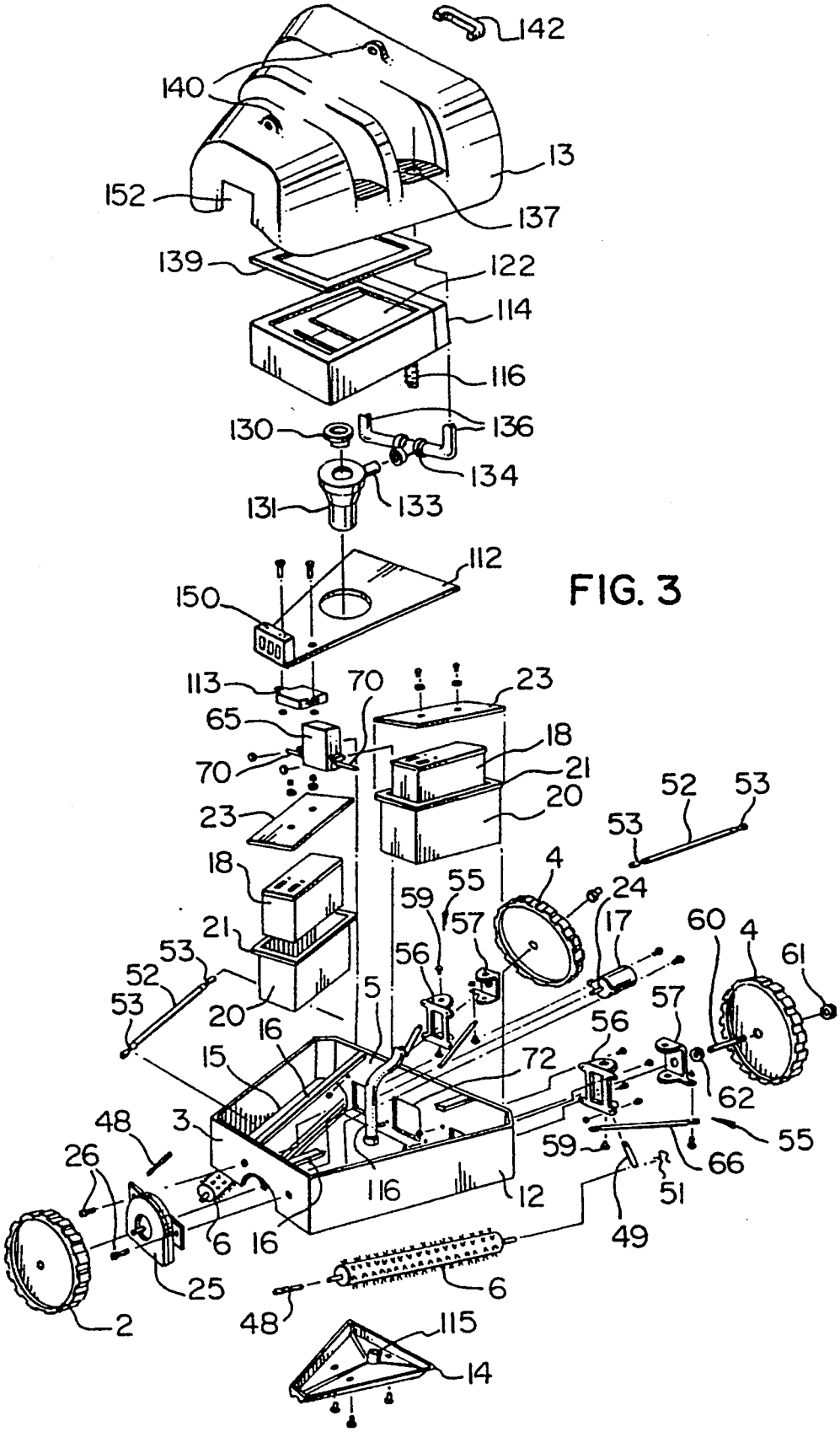
FIG. 3 is an exploded, perspective view of a swimming pool cleaner similar to that shown in FIGS. 1 and 2.
Figure 7:
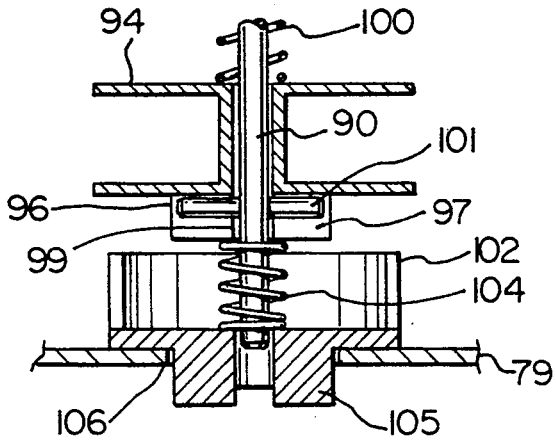
Figure 6:
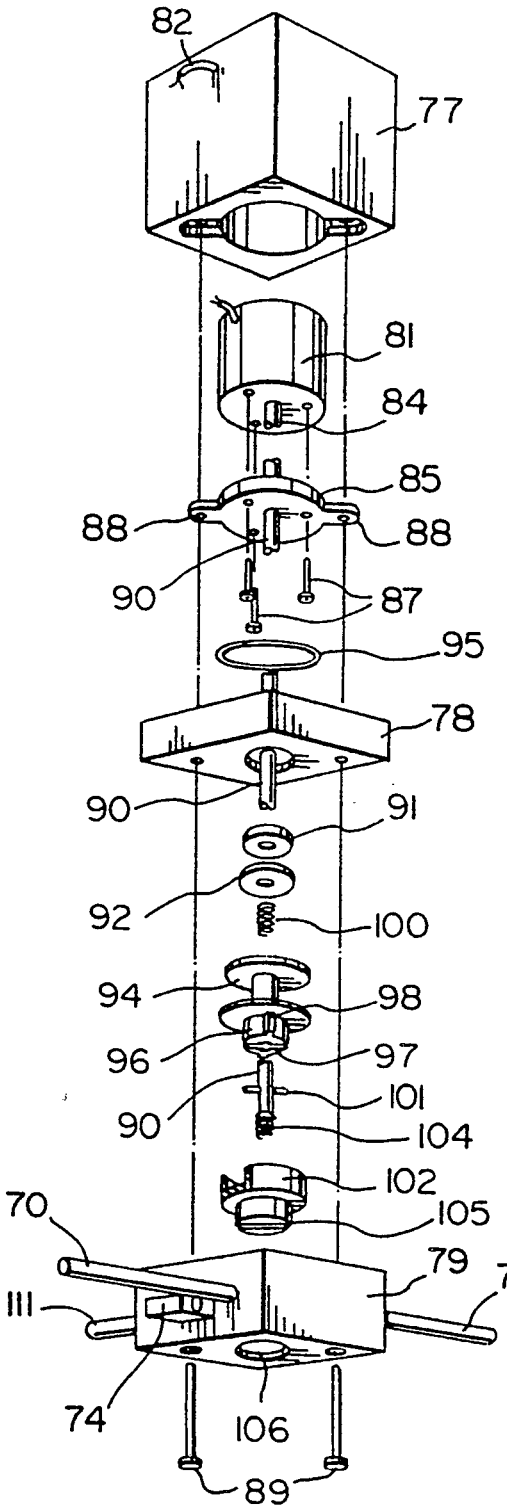
FIG. 6 is an exploded, perspective view of a cable winding device used in the cleaner of FIGS. 1 to 3.
Figure 8:
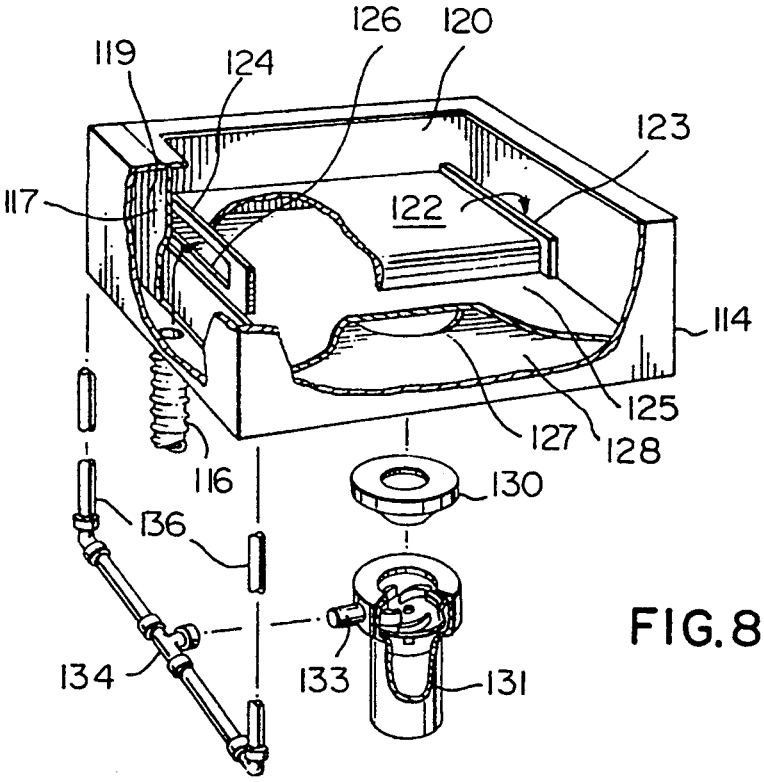
Figure 9:
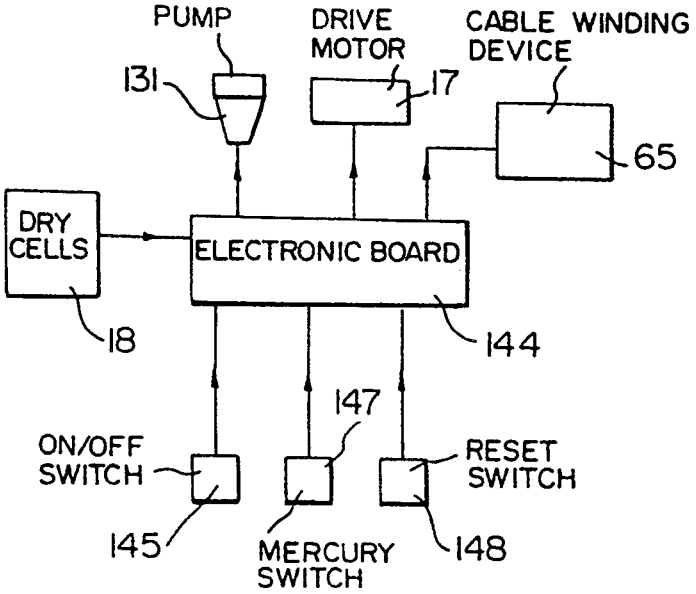
Figure 10:
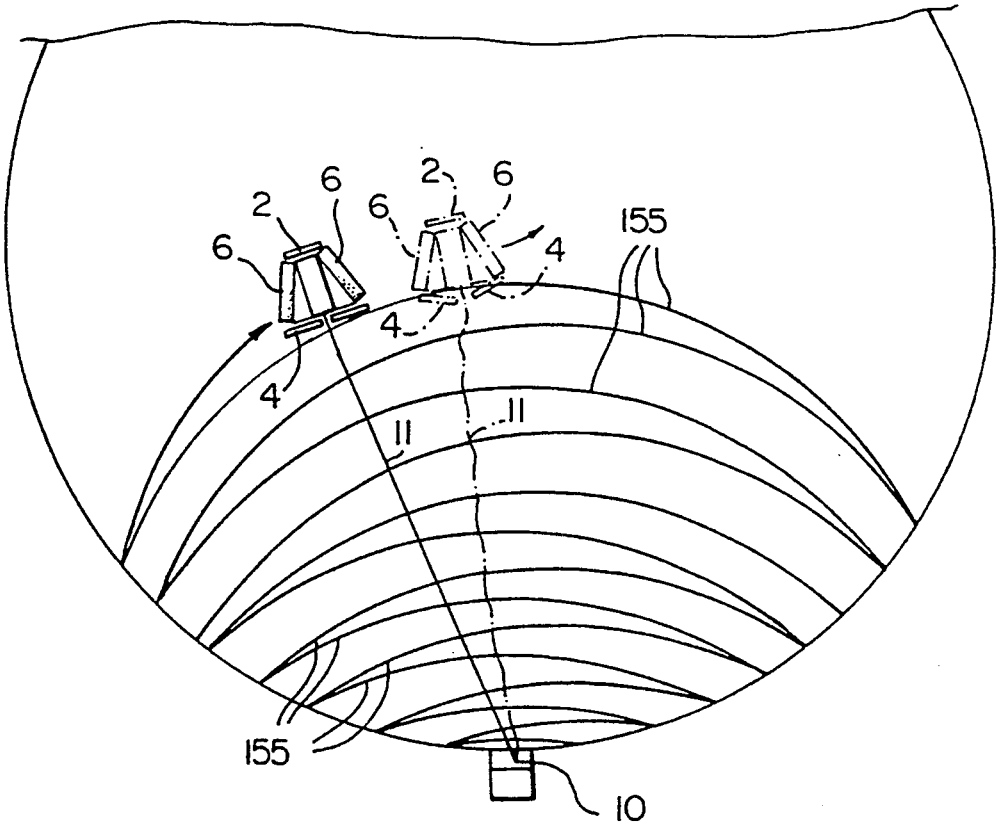

FIG. 7, which appears on the fourth sheet of drawings, is a longitudinal sectional view of a portion of the device of FIG. 6;

FIG. 8 is an exploded, perspective view of a filter used in the cleaner of FIGS. 1 to 3;

FIG. 9 is a schematic, block diagram of a control system used in the device of FIGS. 1 to 3; and FIG. 10 is a schematic, plan view of an area of swimming pool illustrating the operation of a device of the present invention.

DESCRIPTION OF PREFERRED EMBODIMENT

Apparatus—General Description

With reference to FIGS. 1 and 2, the apparatus of the present invention includes a casing 1 carrying a single wheel 2 at one narrow end 3 (FIG. 3) and a pair of wheels 4 at the other wide end 5 thereof. A pair of brushes 6 are rotatably mounted on the bottom of the casing 1 for dislodging dirt from the bottom of a swimming pool. A float 7 is pivotally connected to the casing 1 by arms 8 for providing stability, i.e. for maintaining the casing upright when the apparatus encounters stairs or a side of the pool. The apparatus is connected to a fixed point 10 (FIG. 10) on one side or end of the swimming pool by a cable 11 for determining the path of travel of the apparatus.

Apparatus—Detailed Description

Referring to FIG. 3, in a specific version of the apparatus described above, the casing 1 is defined by an elongated tapering body 12, a cover 13 and a base plate 14. Wells 15 (one shown) for the brushes 6 are provided on the bottom of the body 12, and bars 16 extend longitudinally between the top ends of the body 12. The body 12 carries the wheels 2 and 4, and a drive mechanism for such wheels.

The wheel drive mechanism includes a reversible motor 17 mounted in the body 12. Power for the motor 17 is provided by a pair of batteries or dry cells 18, which are carried by casings 20. Flanges 21 are provided on the top ends of the casings 20 for mounting the latter on the sides of the body 12 and the bars 16. The dry cells 18 are protected by covers 23. The drive shaft 24 of the motor 17 is connected to a gearbox 25 connected to the outer end of the body 12 at the narrow end thereof by bolts 26.

Figure 4:
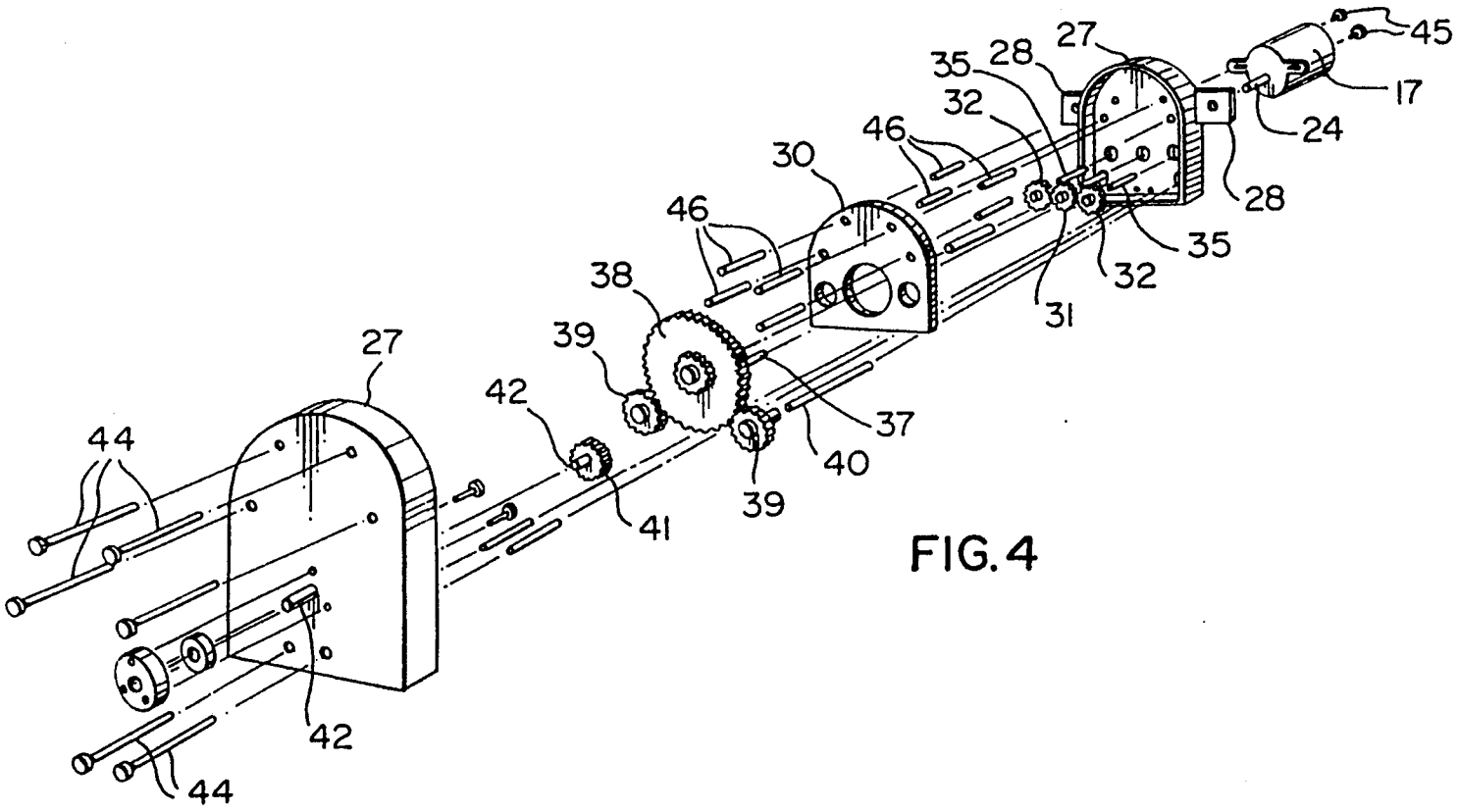
FIG. 4 is an exploded, perspective view of a drive used in the apparatus of FIGS. 1 to 3.

The gearbox 25 (FIG. 4) includes arch-shaped casing halves 27, with flanges 28 on one of the halves for receiving the bolts 26. The interior of the gearbox 25 is divided by a partition 30. Three gears 31 and 32 are provided on the inlet side of the partition 30. A central gear 31 is mounted on the motor drive shaft 24. The gear 31 drives the other gears 32, which carry shafts 35 for rotating the wheels 4. The gear 31 also carries a shaft 37 extending outwardly through the partition 30 into a large gear 38. The gear 38 rotates gears 39 carrying shafts 40 for rotating the brushes 6, and a gear 41 which carries an output shaft 42 for the single wheel 2. The various bolts 44, nuts 45 and sleeves 46 used to interconnect and space apart the elements of the gearbox 24 are illustrated schematically in FIG. 4. The transmission is such that the brushes 6 are rotated more quickly than the wheels 2 and 4.

Figure 5:
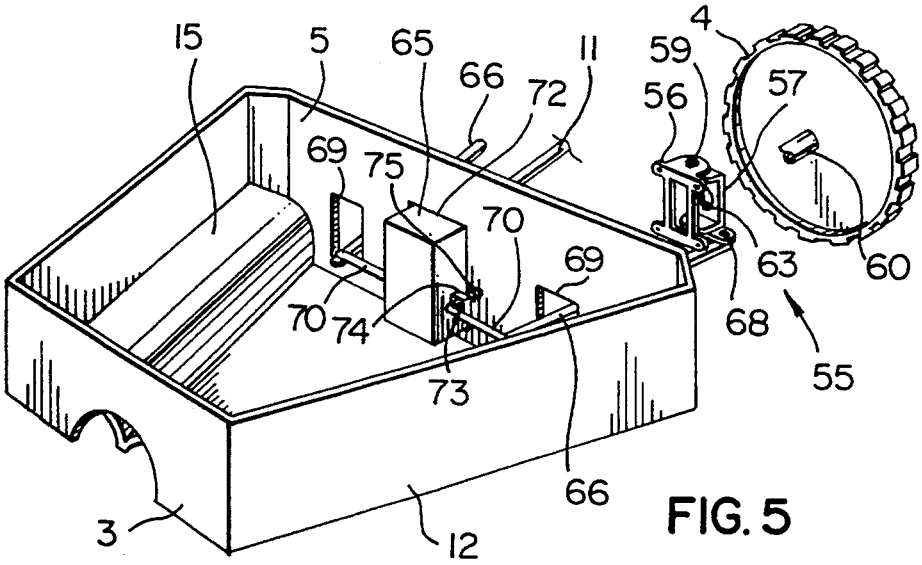
FIG. 5 is an exploded view of a portion of the casing and one wheel of the cleaner of FIGS. 1 to 3.

As best shown in FIG. 3, each shaft 40 is connected to one end of a brush 6 by a universal joint 48. The other end of the brush 6 is connected to a bracket 49 by a clip 51. The shafts 35 for the pair of wheels 4 are connected to such wheels by shafts 52 and universal joints 53. The wheels 4 are rotatably mounted on clevis-like hinges generally indicated at 55 (FIG. 5). Each hinge 55 is defined by a pair of generally C-shaped opposed brackets 56 and 57, which are pivotally interconnected by screws 59. One bracket 56 is mounted on the wide end of the casing body 12, and the other bracket 57 carries the wheel 4. A shaft 60 carrying the wheel 4 extends through the wheel and is maintained therein by a nut 61. The other end of the shaft 60 extends through a bearing 62 and a hole 63 (FIG. 5) in the bracket 57.

Steering of the wheels 4 is effected by a cable winding device 65 and levers 66 connected to lugs 68 on the outer side edges of the brackets 55. The lugs 68 extend outwardly from the brackets 57, and are pivotally connected to the outer ends of the levers 66. Each lever 66 extends through an opening 69 in the wide end 5 of the body 12 to one end of an arm 70. The lever 66 is pivotally connected to such one end of the arm 70, and the other end of the arm 70 is connected to a cable winding device 65, which is slidably mounted in a central opening 72 in the wide end 5 of the body 12. The arms 70 are biased to a position in which the cable winding device is retracted into the body 12 by rods 73 slidable in lugs 74 on each side of the cable winding device and helical springs 75 on such rods biasing the device 65 away form the wide end wall of the body 12.

As described hereinafter in greater detail, the wheels 4 and consequently the apparatus are caused to turn by altering the tension on the cable 11, which is the function of the cable winding device 65. Referring to FIGS. 6 and 7, the cable winding device 65 includes a housing defined by rectangular upper, middle and lower sections 77, 78 and 79, respectively. The upper housing section 77 carries an electric motor 81, which receives power from the dry cells 18 via wire 82. The shaft 84 of the motor is connected to a gear box 85. Screws 87 connect the gearbox 85 to the motor 81, and lugs 88 on the gearbox are used to secure the motor 81 and gearbox in the upper housing section 77. Screws 89 extend through the middle and lower housing sections 78 and 79, respectively and the lugs 88 into the upper housing section 79 to hold the device together. The output shaft 90 of the gearbox 85 extends through a seal 91 in the middle housing section 78 and a washer 92 to a spool 94, which is slidable on the shaft 90. The device 65 is rendered watertight by an O-ring 95 and the seal 91. The washer 92 serves as a bearing surface for the spool 94.

A disc 96 is provided on the bottom end of the spool 94. The disc 96 is bisected by a diametrically extending groove 97 (FIG. 7). A pair of diametrically opposed lugs 98 extend outwardly from the side of the disc 96 perpendicular to the groove 97. An opening 99 for receiving the shaft 90 extends through the centre of the disc 96. A helical spring 100 on the shaft 90 above the spool 94 biases the spool against a crossbar 101 extending through the bottom of the shaft 90 thereby maintaining the spool engaged with the motor drive shaft.

The disc 96 and the crossbar 101 form part of a spool manual release or winding mechanism, which includes a cup 102 and a helical spring 104 on the bottom end of the shaft 90. The cup 102 has a slotted button 105 on the bottom end thereof. The button 105 is accessible through an opening 106 in the lower housing section 79. Upward pressure on the button 105 causes movement of the cup 102 to compress the spring 104 until the cup 102 engages and locks onto the spool 94. Further pressure on the cup 102 causes compression of the spring 100 and upward movement of the spool 94 until it presses against the washer 92, at which point the spool is disengaged from the crossbar 101 and is free to rotate to either release, or to wind the cable if manually forced to rotate in the opposite direction. Thus, the spool 94 can be rotated in the opposite direction to rewind the cable 11 as required after each cleaning operation. A cable guide tube 111 extends out the lower housing section 79 perpendicular to the arms 70.

Referring to FIGS. 3 and 8, a plate 112 mounted on the body 12 supports a filtration system and an electronic control device 113. The filtration system includes a rectangular filter housing 114 for receiving pool water through an inlet 115 (FIG. 3) in the base plate 14 and an inlet duct 116. A vertical partition 117 divides the interior of the housing 114 into an inlet chamber 119 and a filter chamber 120. A domed filter 122 (FIG. 8) with a closed end 123 and an open end 124 is mounted on a ledge 125 in the filter chamber 120. Water entering the inlet chamber 119 flows through an opening 126 in the partition 117 and the open end 124 of the filter 122. The water passes through the filter 122 and around one end of the ledge 125, and exits through an outlet opening 127 in the bottom wall 128 of the housing 114, and a seal 130 to the inlet end of a pump 131. The pump 131 is mounted on the plate 112. The water is discharged via an outlet duct 133, a T-joint 134, outlet pipes 136 and openings 137 (FIG. 3) in the cover 13. A seal 139 is provided between the open top end of the filter housing 114 and the cover 13. In the version of the invention shown in FIG. 3, the float (not shown) is connected to lugs 140 on the cover 13, and a handle 142 is provided on the cover for carrying the device.

With reference to FIG. 9, the control for the device includes an electronic board 144 mounted in the device 113 and connected to an on/off switch 145, the dry cells 18, the drive motor 17, the cable winding device 65, the pump 131, a mercury switch or switches 147 mounted directly on the electronic board 144 for reversing the direction of travel of the device and starting of the cable winding device 65.

The on/off switch 145 and a cleaning timer reset switch are provided in a module 150 (FIG. 3) mounted on the plate 112 and accessible through an opening 152 in one end of the cover 13. The switch 147 for reversing the direction of travel of the cleaner is mounted on the module 150.

In operation, if the cleaner is started at point 10, at the end of every cleaning cycle the user will have to rewind the cable. This is achieved by inserting a screw driver into the slot in the button 105 and pushing the button in, thus releasing the spool 94 from the crossbar 101 and hence from its engagement with the drive shaft 100. The spool 94 can then be freely turned in the desired direction to rewind the cable. As the button 105 is released, the spring 100 returns the spool 94 to its normal position engaged with the crossbar 101, and the spring 104 disengages cup 102 from the spool 94. If the cleaner is to be started at the opposite end of the pool, then manually depressing the button 105 will disengage the spool from the crossbar 101 and allow the cable to unwind freely because one end of the cable is attached to point 10 (FIG. 10) and the cleaner is carried to the opposite end. The use of a switch (not shown) actuated by the float 7 ensures that the device will reverse direction if it reaches the surface of the water. The cleaner is started, and during movement the mercury switches cause the device to reverse direction each time the cleaner contacts and begins to climb an obstacle such as a wall. Time delays are incorporated in the logistics of the device either to provide time for the cleaner to react before making a decision or to prevent damage to the apparatus as could happen, for example if the cleaner was permitted to reverse direction of travel instantly. The timers include (a) a first timer for overriding the mercury switches in the event that the device does not contact a wall within a predetermined time lapse, (b) a second timer for controlling the total cleaning time to deactivate the unit after the total area has been covered, and (c) a third timer for controlling the duration of operation of the cable winding device 65 each time the unit reverses direction of travel. The second timer is set by the user using the reset switch 148 (FIG. 9) in accordance with the pool dimensions. The third timer is preset by the manufacturer. The third timer is not required to achieve the pattern of FIG. 10, i.e. a continuous series of arcs 155 interconnect at alternate ends. The third timer would be used to achieve a pattern in which the ends of the arcs are squared off so that the arcs 155 are parallel.

It will be appreciated from the foregoing that the device of the present invention will clean the inner surface of a swimming pool in a predetermined pattern, and under controlled conditions, which reduces the time required to clean the entire surface of the pool. The cleaner is independent of other pool accessories such as the water filtering system so that such other systems can continue functioning in their normal operating modes during the cleaning operation. Articles are dislodged from the surface being cleaned by means of the two rotating brushes 6, which are angled with respect to the longitudinal axis of the cleaner. The brushes 6 are driven independently at a speed slightly higher than that of the wheels 2 and 4. The use of a generally triangular cleaner configuration ensures that the pool edges and corners are cleaned efficiently.

The filtering system illustrated in FIG. 8 is designed in such a manner to minimize potential clogging by leaves or similar material. Because the filter 122 is upstream from the pump or turbine 131, particles are removed from the water before the water enters the pump. The filter is located immediately under the cover 13, and thus is readily accessible for cleaning or replacement. The use of an elongated filter enables the cleaner to contain a maximum amount of dirt without blocking of the filter. The flow of water through the filter is such that filtered materials will accumulate at one end of the filter, and build up towards the opposite end thereof until the entire filter is occupied. Thus, there is no gradual clogging of the entire filter area, accompanied by steadily decreasing suction capabilities.

Finally, the use of a casing 1, which tapers from one end to the other thereof, with a single wheel at the narrow end and a pair of wheels at the wide and facilitates movement in the pattern shown in FIG. 10. By suitable angling of the two wheels 4 at one end of the casing 1, the cleaner will normally travel in an arc, the radius of which is defined by the cable 11. By making minor adjustments, i.e. by removing and replacing the tension on the cable using the cable winding device 65, the levers 66 and the springs 75, course corrections are effected during the entire cleaning operating to ensure that the cleaner follows the predetermined path of travel. The use of articulated links between the wheels 4 and the cable winding device 65 ensures that any movement of the cable winding device 65 is translated into a change in the orientation of the wheels 4 to effect a change in the path of travel of the cleaner. By spring loading the links in a manner to act in a direction opposite to the cable tension, any release of cable tension will result in the wheels adopting an angle between them designed to restore the cleaner to the desired trajectory. As soon as the trajectory has been corrected, tension on the cable 11 is restored to straighten the wheels 4.

As the tension in the cable 11 increases, the cable winding device 65 is pulled towards the wall 5 of the body 12 and thereby pushes the wheels 4 to change direction in such a way that the cleaner follows the arc described by the cable under tension. Should the cleaner deviate from this path and the tension on the cable 11 decrease, the springs 75 will push the cable winding device 65 away from the wall 5 of the body 12, which in turn changes the orientation of the wheels 4 so that the cleaner is directed along an arc opposite to the one naturally described by the cable under tension, thus reestablishing tension on the cable so that the cleaner recovers its normal pattern.

The cleaner is designed to accommodate a variety of power sources. In the embodiment illustrated, batteries 18 are used to operate the various elements of the cleaner. It will be appreciated that the battery pack can also be separate from the cleaner, e.g. float on the surface of the pool or sit on the pool side. It is also possible to utilize a transformer located at a safe distance from the pool. In all cases where the power supply is external to the cleaner, the power supply cable to the cleaner is equipped with floats, which keep the cable clear of the unit to avoid obstruction.

The embodiments of the invention in which an exclusive property or privilege is claimed are defined as follows:

1. A swimming pool cleaner of the submersible type comprising casing means; first wheel means on one end of said casing means; second wheel means on the other end of said casing means; brush means rotatably mounted on said casing means for dislodging dirt from a pool bottom; pump means in said casing means for pumping water through said casing means; filter means in the path of travel of the water pumped by said pump means for rotating said first and second wheel means and said brush means; switch means for causing the drive means to reverse the direction of travel upon reaching a pool wall; cable means for connecting said casing means to a point on the periphery of the swimming pool for causing the cleaner to follow an arcuate path of travel, the trajectory of the path being dependent upon the distance between the cleaner and said point; winding means for changing the length of said cable means whereby the distance between said point and the cleaner is changed; release means connected to said winding means permitting coiling or uncoiling of said cable means; and spring means biasing said second wheel means to a turning position, whereby, by changing the tension on said cable means, while continuing to drive said wheel means, the cleaner can be caused to turn to effect corrections to the path of travel of the cleaner.

2. A swimming pool cleaner according to claim 1, wherein said drive means includes first motor means in said casing means; transmission means connected to said first motor means; and shaft means connected to said transmission means and to each said first and second wheel means for rotating said wheel means in unison.

3. A swimming pool cleaner according to claim 1, wherein said winding means includes spool means in said casing means for receiving the cable means; second motor means; shaft means extending out of said second motor means for rotating said spool means; and cable housing means carrying said second motor means, shaft means and spool means in said casing means.

4. A swimming pool cleaner according to claim 3, wherein said release means including second spring means normally biasing said spool means to engagement with said shaft means; and pushbutton means extending out of said cable housing means for pushing said spool means out of engagement with said shaft means, whereby the spool means can unwind freely.

5. A swimming pool cleaner according to claim 4, wherein said release means includes third spring means for returning said spool means to the shaft means engaging position when pressure on said pushbutton means is released.

6. A swimming pool cleaner according to claim 1, wherein said filter means includes filter housing means; partition means dividing said filter housing means into inlet and outlet chambers; ledge means in said outlet chamber, an outlet opening in said filter housing means beneath said ledge means; and a dome filter on said ledge means with a first closed end in said outlet chamber and a second end opening into said inlet chamber, whereby liquid entering said inlet chamber flows into said filter, through the filter and over the ledge to said outlet opening.

* * * * *